US008225524B1

(12) United States Patent
Bettencourt

(10) Patent No.: US 8,225,524 B1
(45) Date of Patent: Jul. 24, 2012

(54) AIR WIPING DEVICE

(75) Inventor: Stephen Bettencourt, Warren, RI (US)

(73) Assignee: Huestis Machine Corporation, Bristol, RI (US)

( * ) Notice: Subject to any disclaimer, the term of this patent is extended or adjusted under 35 U.S.C. 154(b) by 447 days.

(21) Appl. No.: 12/689,424

(22) Filed: Jan. 19, 2010

(51) Int. Cl.
*F26B 25/00* (2006.01)

(52) U.S. Cl. ..... 34/104; 34/614; 34/107; 241/36; 241/39; 110/347; 95/241; 166/275

(58) Field of Classification Search ..... 34/90, 104, 34/105, 106, 107, 138, 611, 614; 166/275; 95/241; 110/347; 241/36, 39
See application file for complete search history.

(56) References Cited

U.S. PATENT DOCUMENTS

| | | | | |
|---|---|---|---|---|
| 1,994,443 | A * | 3/1935 | Bailey | 110/347 |
| 2,233,304 | A * | 2/1941 | Bleakley | 239/80 |
| 3,001,242 | A * | 9/1961 | Heffelfinger | 19/145.5 |
| 3,228,113 | A * | 1/1966 | Fannon, Jr. | 34/308 |
| 4,331,730 | A * | 5/1982 | Sorenson | 442/334 |
| 4,798,007 | A * | 1/1989 | Eichenlaub | 34/267 |
| 5,210,958 | A * | 5/1993 | Bond et al. | 34/422 |
| 5,551,226 | A | 9/1996 | Keir et al. | |
| 5,634,236 | A | 6/1997 | Darsey | |
| 5,943,729 | A | 8/1999 | Watkins | |
| 6,267,822 | B1 | 7/2001 | Watkins | |
| 6,760,981 | B2 * | 7/2004 | Leap | 34/210 |
| 6,865,875 | B2 | 3/2005 | Watkins | |
| 2003/0136019 | A1 * | 7/2003 | Leap | 34/210 |
| 2004/0172932 | A1 | 9/2004 | Watkins | |
| 2007/0107256 | A1 * | 5/2007 | Wiener et al. | 34/497 |
| 2008/0155853 | A1 * | 7/2008 | Wang et al. | 34/285 |
| 2009/0131852 | A1 | 5/2009 | Hooi | |
| 2010/0163232 | A1 * | 7/2010 | Koll | 166/275 |
| 2012/0037736 | A1 * | 2/2012 | Ito et al. | 241/39 |

* cited by examiner

*Primary Examiner* — Stephen M. Gravini
(74) *Attorney, Agent, or Firm* — Huestis Machine Corporation; O'Neal R. Mistry, Esq.

(57) ABSTRACT

An air wiping device for drying an elongated product that passes through the air wiping device. The air wiping device includes a housing having an internal elongated tubular passage through which the elongated product extends and including opposite one and other ends with the housing tubular passage having an inlet end and an outlet end for respectively receiving and passing the elongated product; a first set of nozzles mounted at the one end of the housing for communicating a compressed gas stream to the internal elongated tubular passage and second set of nozzles mounted at the other end of the housing for communicating a compressed gas to the internal elongated tubular passage. The first and second sets of nozzles are mounted for directing the respective gas streams obliquely to the internal elongated tubular passage. The first and second sets of nozzles are mounted for directing the respective gas streams in a direction having a compressed gas stream component toward each other for discharge transversely from the housing.

20 Claims, 9 Drawing Sheets

AIR WIPING DEVICE

RELATED APPLICATIONS

This application relates to co-pending application Ser. Nos. 12/689,384 and 12/689,466 filed of even date herewith. These related applications are now hereby incorporated by reference herein in their entirety.

TECHNICAL FIELD

The present invention relates in general to an air wiping device. More particularly the present invention relates to a cleaning device for a variety of different types of products, particularly elongated members such as fiber, wiring or cabling. Even more particularly the present invention relates an air wiping device that is characterized by an improvement on the drying process.

BACKGROUND OF THE INVENTION

In the manufacturing of wire, or other similar elongated products, there is a need to remove liquids and contaminants from the surface of the product. For example, in the production of wire, it is necessary that cooling fluids or cleansing acids be removed from the wire prior to spooling, storage, or subsequent processing. It is known in this art to use compressed air to remove liquid or contaminants from wire, or the like, as it passes through a tube. By way of example refer to U.S. Pat. Nos. 5,634,236 and 6,267,822, as well as an air wipe product sold by Huestis Machine Corporation of Bristol R.I., and the assignee of the present invention, all of which are hereby incorporated by reference herein in their entirety. These known air wiping devices use compressed air that is vented into the tube through radially or tangentially directed holes and the liquid is removed by the force of the pressurized air traveling in the opposite direction of the moving wire. There have been numerous problems associated with past attempts to remove liquid from moving elongated members using such prior art methods.

One problem associated with known air wiping devices is that when one desires to change the cable size being processed, the entire air wipe product has to be substituted. Another problem with known air wiping devices is that in order to provide a hard surface in the inner tube of the air wiping device the entire device is usually constructed of a ceramic material as mentioned in U.S. Pat. No. 6,267,822. This makes the device expensive to manufacture. Also other devices that are used are constructed of materials that do not withstand the wear caused by the passing cable (at high speed), and thus damage to the device is common, particularly where initial misalignment occurs.

Another problem with existing devices is that when they are ganged in series there can be interference from one device to the next adjacent device. This occurs because the exhausted liquid tends to pass in a direction opposite to the direction of conveyance of the elongated member. Thus, there is a tendency for liquid, from a downstream device, to undesirably impact on the upstream device. In many facilities where air wiping devices are used there is a severe space constraint and thus these air wiping devices have to be mounted quite close to each other. The end result is that the ganging of these devices does not attain the desired result, namely of properly drying the elongated member.

Accordingly, it is an object of the present invention to provide an improved air wiping device in which the discharge from the device is directed so as to not interfere with any adjacently disposed devices.

Another object of the present invention is to provide an improved air wiping device that is characterized by using two sets of nozzles that direct the output flow from the device in a direction that is substantially orthogonal to the direction of movement of the elongated member being dried.

SUMMARY OF THE INVENTION

In accordance with the present invention there is provided an air wiping device for drying an elongated product that passes through the air wiping device. The air wiping device comprises a housing having an internal elongated tubular passage through which the elongated product extends and including opposite one and other ends; the housing tubular passage having an inlet end and an outlet end for respectively receiving and passing the elongated product; a first set of nozzles mounted at the one end of the housing for communicating a compressed gas stream to the internal elongated tubular passage; and a second set of nozzles mounted at the other end of the housing for communicating a compressed gas to the internal elongated tubular passage. The first and second sets of nozzles are mounted for directing the respective gas streams obliquely to the internal elongated tubular passage. Moreover, the first and second sets of nozzles are mounted for directing the respective gas streams in a direction having a compressed gas stream component toward each other for discharge transversely from the housing.

In accordance with other aspects of the present invention the housing is separated into two housing sections; the housing sections are connected by a hinge that biases the housing sections to a closed position; each of the sets of nozzles are disposed about a 360 degree locus; each of the housing sections is substantially semi-circular in shape; the input end of the housing tubular passage includes a tapered input through which the elongated product is received and an output through which the elongated product passes from the housing; including a mounting bracket for the housing that mounts the housing in a manner by which the housing may still move toward an open position should an object associated with the elongated product engage the tapered input so as to avoid damage to the device; the housing sections include a slot that is used for the support of the housing from the bracket; the first and second sets of nozzles extend at substantially the same angle to the longitudinal axis of the housing; the elongated tubular passage is defined with a tapered input through which the elongated product is received and an output through which the elongated product passes from the housing; the housing includes a transverse port that extends substantially orthogonal to the elongated tubular passage in the housing and for receiving the discharge from the housing; and the housing includes a pair of separable housing sections and a transverse port that extends between the housing sections substantially orthogonal to the elongated tubular passage in the housing and for receiving the discharge from the housing.

In accordance with other versions of the present invention there is provided an air wiping device for drying an elongated product that passes through the air wiping device. The air wiping device comprises a housing having an internal elongated tubular passage through which the elongated product extends and including opposite one and other ends; the housing tubular passage having an inlet end and an outlet end for respectively receiving and passing the elongated product; a first set of air outlets mounted at the one end of the housing for communicating a compressed gas stream to the internal elongated tubular passage; and a second set of air outlets mounted at the other end of the housing for communicating a compressed gas to the internal elongated tubular passage. The first and second sets of air outlets are mounted for directing the respective gas streams obliquely to the internal elongated tubular passage while the first and second sets of air outlets are mounted for directing the respective gas streams in a direction having a compressed gas stream component toward each other for discharge transversely from the housing. Each set of air outlets directs an air stream at substantially the same angle to the elongated member axis, and each at an angle less than 90 degrees.

In accordance with still other aspects of the present invention the housing is separated into two housing section, the housing sections are connected by a hinge that biases the housing sections to a closed position and each of the sets are disposed about a 360 degree locus; each of the housing sections is substantially semi-circular in shape; the input end of the housing tubular passage includes a tapered input through which the elongated product is received and an output through which the elongated product passes from the housing; including a mounting bracket for the housing that mounts the housing in a manner by which the housing may still move toward an open position should an object associated with the elongated product engage the tapered input so as to avoid damage to the device; the housing sections include a slot that is used for the support of the housing from the bracket; the housing includes a transverse port that extends substantially orthogonal to the elongated tubular passage in the housing and for receiving the discharge from the housing; and the housing includes a pair of separable housing sections and a transverse port that extends between the housing sections substantially orthogonal to the elongated tubular passage in the housing and for receiving the discharge from the housing.

DESCRIPTION OF THE DRAWINGS

Numerous other objects, features and advantages can be realized in accordance with the present invention by referring to the accompanying drawings, in which.

DETAILED DESCRIPTION

Reference is now made to the present preferred embodiment of the present invention which is illustrated in the accompanying drawings. The device of the present invention removes particulate matter or other adherent material from an elongated member such as wiring or cabling. The device will effectively remove any material loosely adhered to the elongated member such as liquids, particulate solids, contaminants or combinations thereof. Although it shows particular utility in removing liquids or other materials from elongated solids such as wires or cables, the principles of the present invention may also apply to cleaning any number of other elongated substances.

In accordance with the present invention, the device generally includes a housing having a chamber with a plurality of air inlets for receiving compressed air into the chamber, a central tube for receiving an elongated member as it is traveling into the chamber, and an exit for allowing the elongated member to leave the chamber. Furthermore, the compressed air is generally expelled (with removed material) through the central tube.

Figure 1:
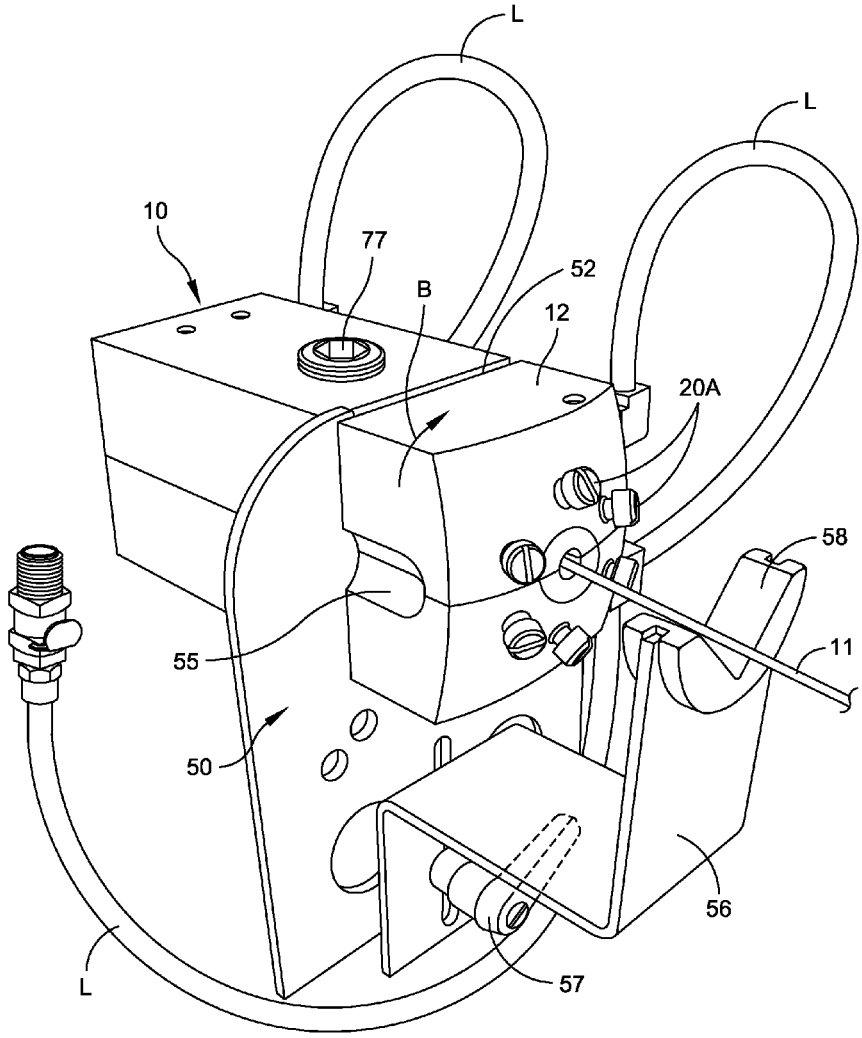
FIG. 1 is a perspective view of one embodiment of the air wiping device constructed in accordance with the principles of the present invention and illustrated as supported from a mounting bracket.
Figure 8:
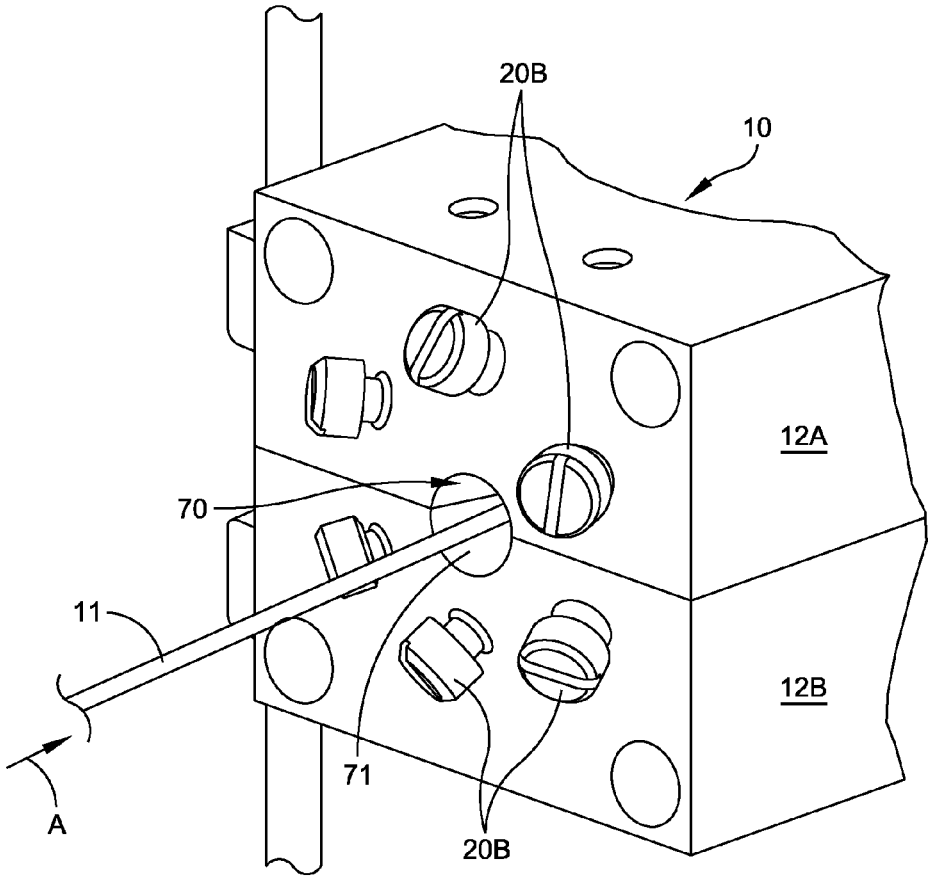
FIG. 8 is a fragmentary perspective view at the left side of the device.
Figure 9:
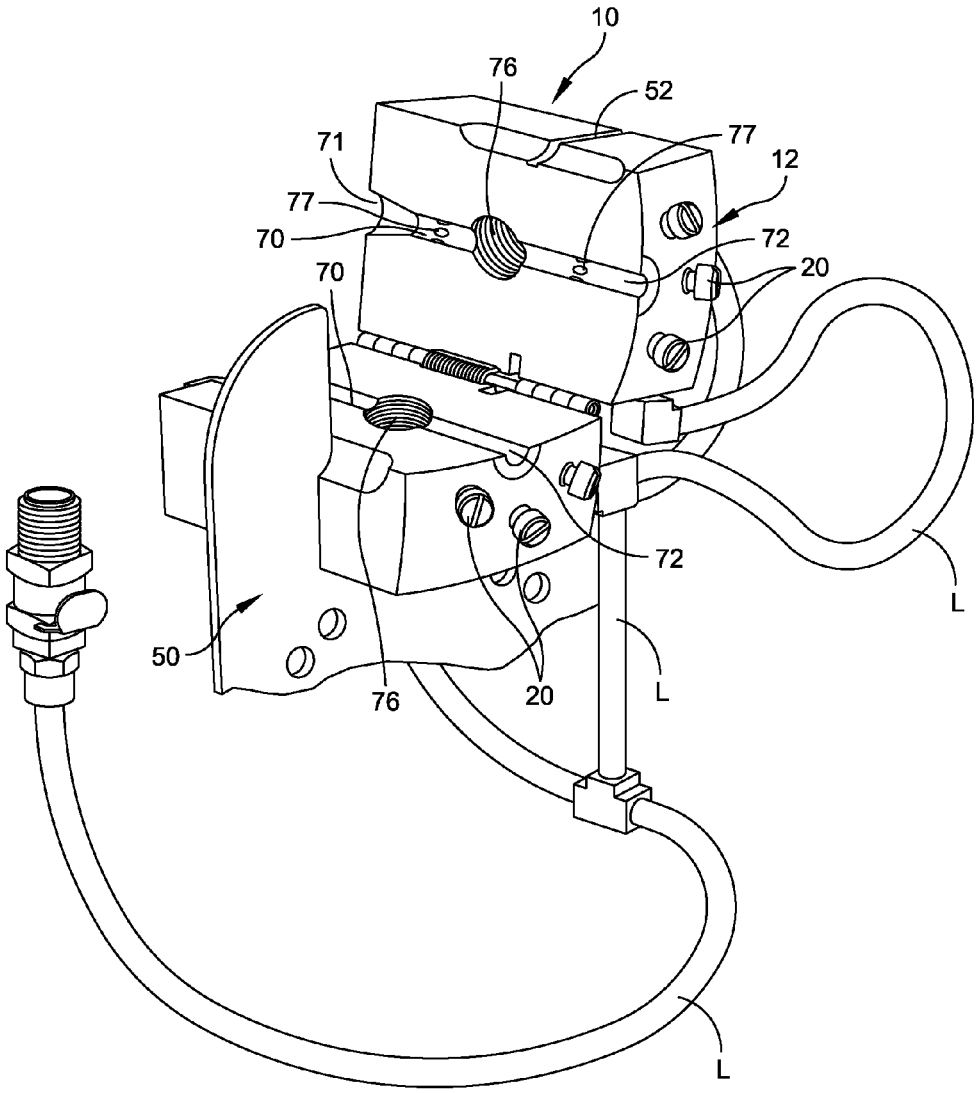
FIG. 9 is a perspective view of the device of FIG. 1 with the housing in an open position.

As here embodied and depicted in the drawings, there is shown an air wiping device designated by the numeral 10. The device 10 is used to remove liquid and/or other materials from an elongated member 11 having a generally circular cross-sectional area and moving in the direction of the arrows A illustrated in FIGS. 3, 6 and 8. Additionally, air wiping device 10 is depicted as being used in conjunction with a compressed air delivering system (not shown). Part of the delivery system is shown in FIGS. 1 and 9 by the air lines L. Device 10 includes housing 12 having an internal plenum chamber 14 into which the compressed air is coupled from the lines L. The chamber 14 couples the compressed air to the plurality of nozzles 20. The nozzles 20 are each meant to provide a jet stream of air or any other gas directed to the elongated product as the elongated product or member is conveyed through the air wiping device.

Figure 4:
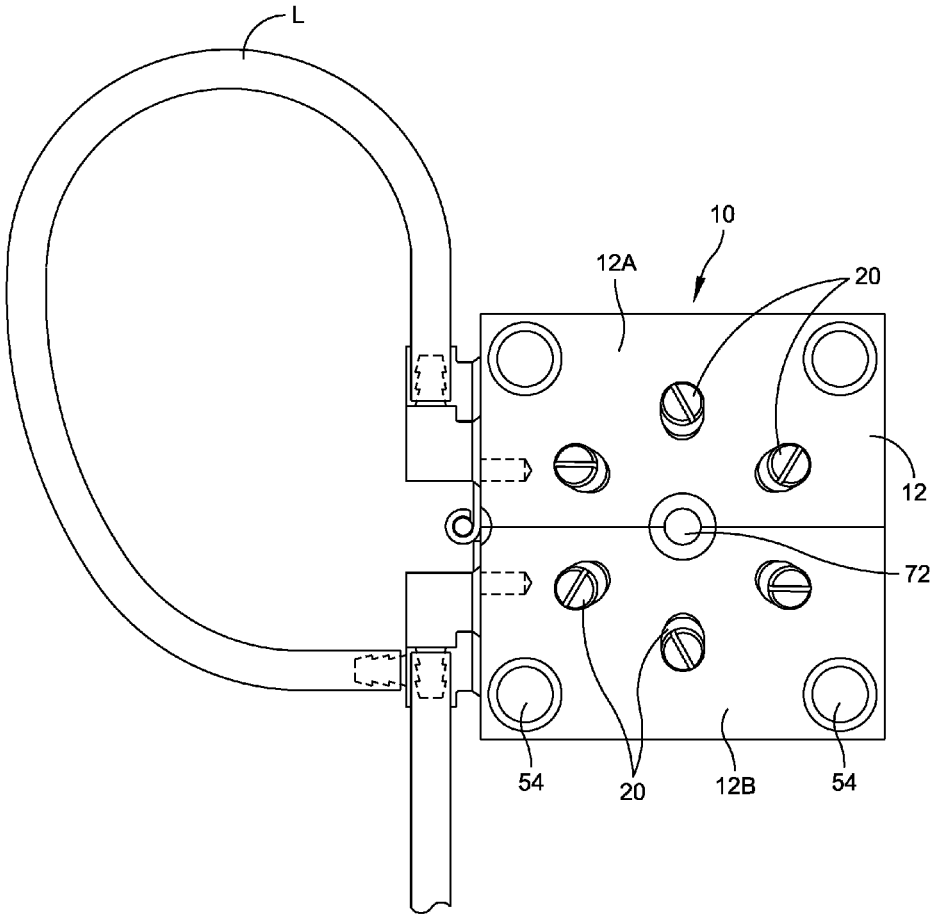
FIG. 4 is a left side view of the air wiping device of FIG. 1.

Reference is now made to the perspective view of FIG. 1 that illustrates the air wiping device 10 of the present invention as supported by the bracket 50. Refer also to the partial perspective view of FIG. 9 which shows a portion of the bracket 50. The bracket supports the device 10 primarily by means of an engagement of the planar-shaped bracket 50 with the slot 52. From FIG. 9 it is noted that the bracket 50 is open at its top end so that the housing 12 can move from a closed position as illustrated in FIG. 1 to an open position as illustrated in FIG. 9. A pair of spring loaded ball plungers engage mating holes in the bracket providing tooless unit removal from the bracket or securing screws may be used for securing the housing to the bracket. This is illustrated in FIG. 4 wherein passages 54 may accommodate securing screws that may be spring loaded and have ends that are urged against the planar surface of the bracket 50.

The bracket 50 may also support a further bracket 56 whose position relative to the bracket 50 is adjustable by means of a knob 57. A top end of the bracket 56 supports a guide piece 58 through which the elongated member may be supported and extend. The guide piece 58 is preferably constructed of a hard material such as a ceramic material.

The housing 12 is illustrated as being formed in two sections with a common depression 55 that provides a gripping surface for opening the two sections of the housing against the bias of a supporting spring. FIG. 1 also illustrates by arrow B the direction of opening of a top housing section relative to a bottom housing section.

Figure 3:
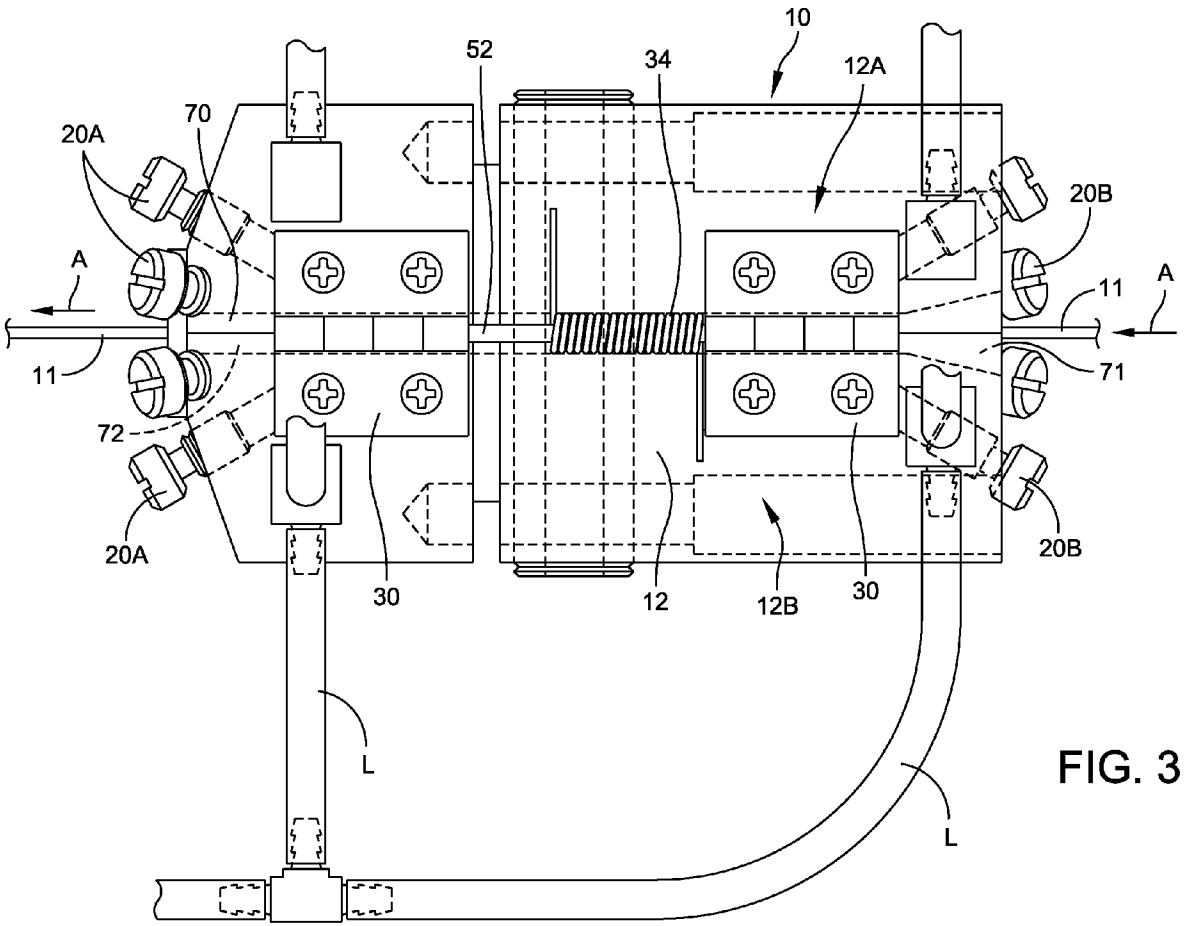
FIG. 3 is a rear view of the air wiping device of FIG. 1.

The housing 12 is considered as separated into two like housing sections identified as sections 12A and 12B in the drawings. These two sections are interconnected by means of a hinge arrangement that is best illustrated in FIG. 3. This includes hinge plates 30, hinge pin 32 and biasing spring 34. The hinge pin 32 extends between the hinge plates 30 and the biasing spring 34 is wound about the hinge pin 32. This arrangement biases the two housing sections to a closed position such as the one illustrated in FIG. 1.

Figure 2:
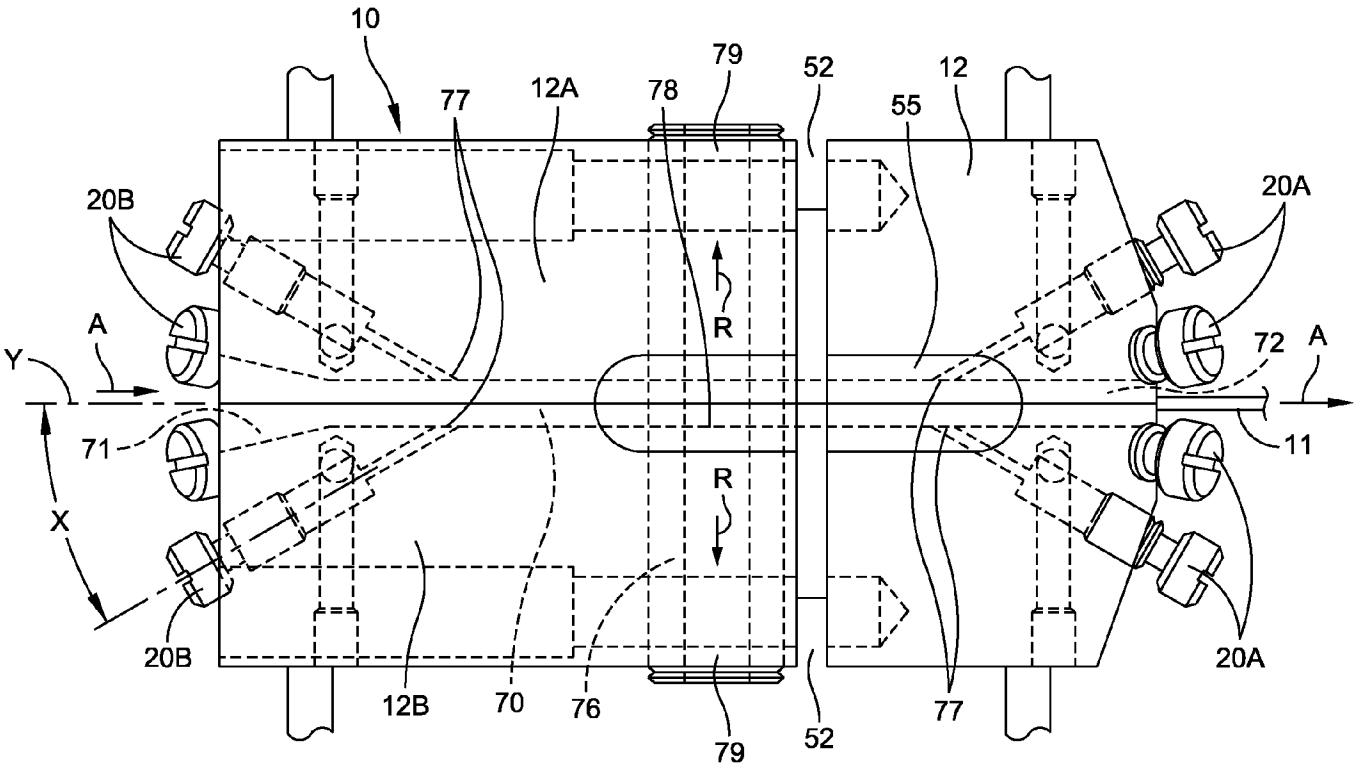
FIG. 2 is a front view of the air wiping device of FIG. 1.
Figure 5:
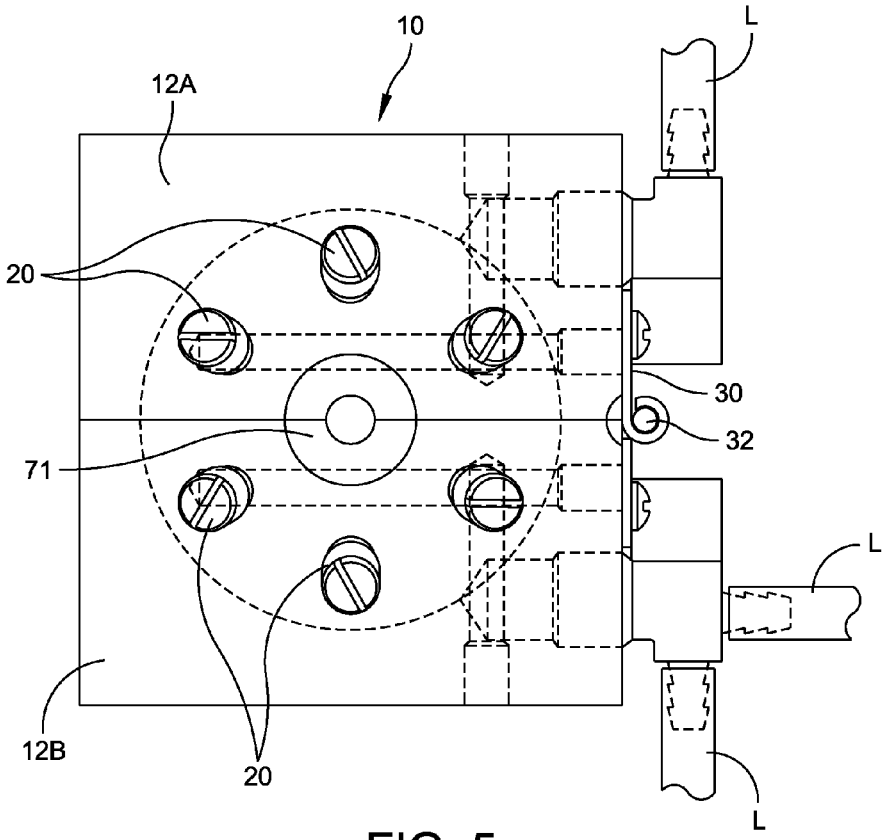
FIG. 5 is a right side view of the air wiping device of FIG. 1.
Figure 6:
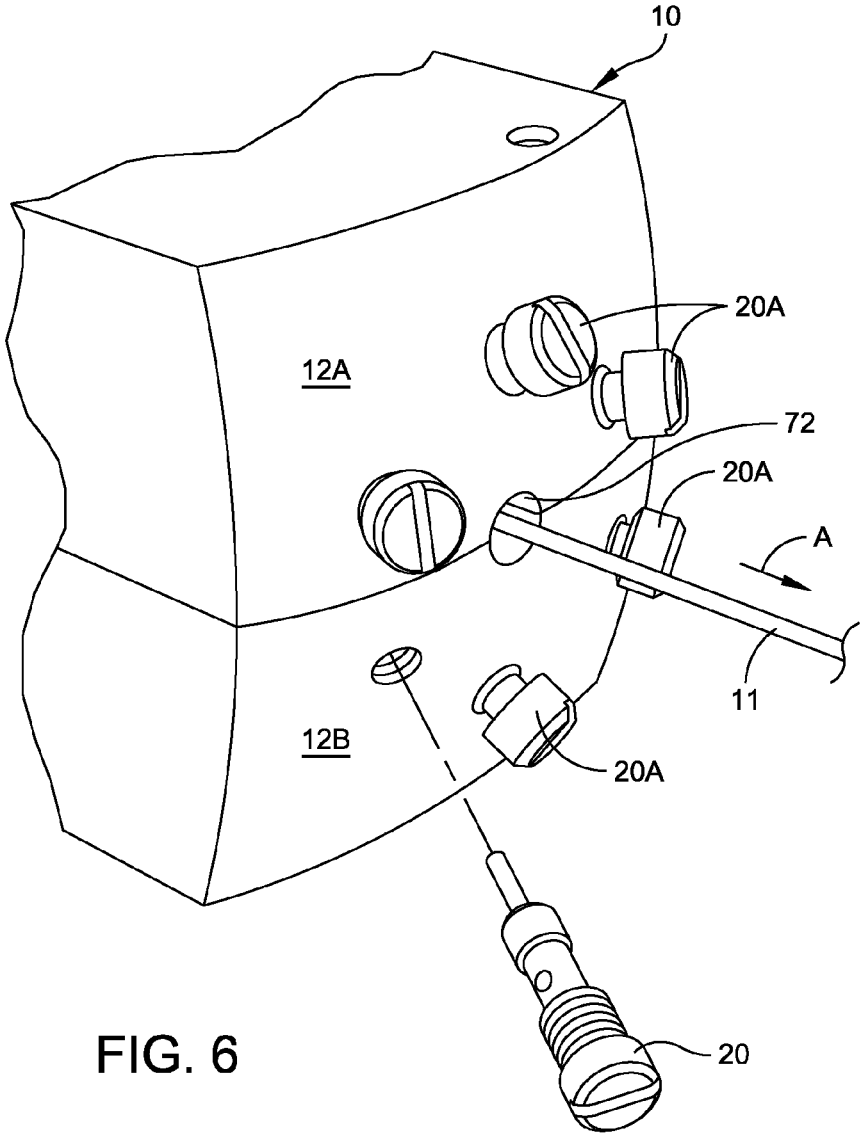
FIG. 6 is a fragmentary perspective view at the right side of the device and showing the nozzle exploded from the housing.
Figure 7:
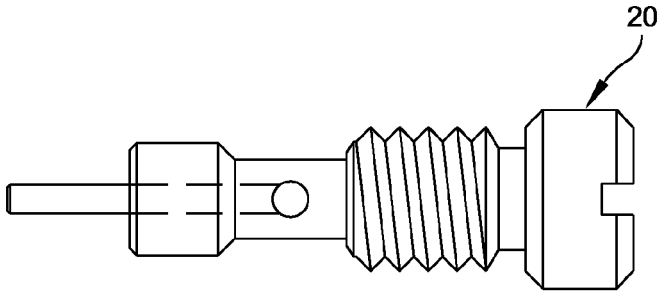
FIG. 7 is an illustration of the nozzle.
Figure 10:
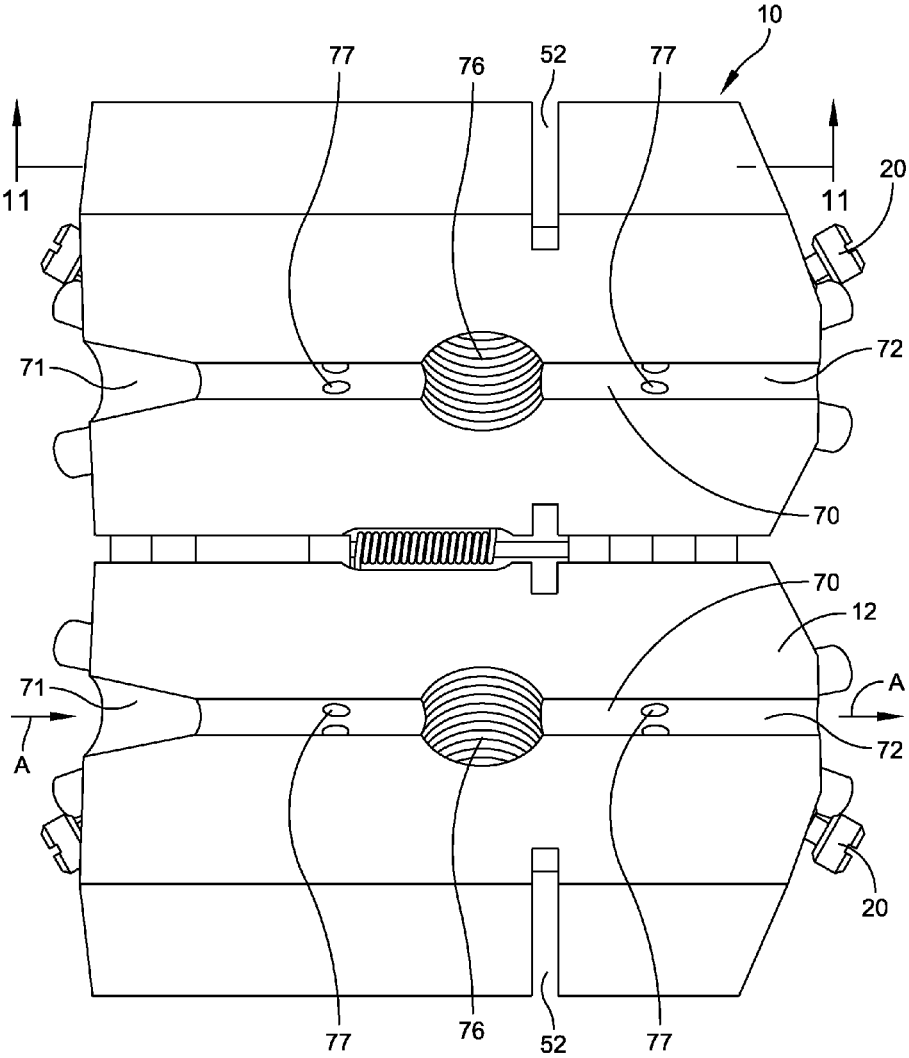
FIG. 10 is a front view with the housing open.

FIG. 2 illustrates the position of the nozzles 20. These nozzles are adapted to be screwed into the respective housing sections with their being provided in the disclosed embodiment three nozzles for each of the housing sections. In this regard refer to FIG. 5 that shows the three separate nozzles associated with respective housing sections 12A and 12B. Refer also to FIG. 2 which shows the nozzles 20 coupling to the plenum chamber 14. Refer also to FIGS. 6 and 7. FIG. 7 in particular illustrates the construction of the nozzle 20 which includes a head, a threaded section and a port through which the compressed air passes. The nozzles are disposed so as to direct compressed air from an input plenum to an elongated internal tubular passage. FIG. 10 illustrates the general shape of this internal passage. The nozzles 20 may be of conventional design.

As indicated previously in accordance with the present invention, there is provided an air wiping device for drying an elongated member or product that passes through the air wiping device. The device basically includes a housing 12 in separate housing sections 12A and 12B that together define an internal elongated tubular passage 70 through which the elongated product extends. The elongated tubular passage 70 has an inlet end 71 that is tapered as illustrated in FIGS. 3, 9 and 10. Refer also to FIG. 2. The passage 70 also includes an outlet end 72. The passage 70 may be of the same diameter along almost its complete length with the exception of the input taper at 71.

In the embodiment that is described herein, at each end of the device there is a set of nozzles for communicating a compressed gas stream to the internal elongated tubular passage 70. These are provided in two separate sets of nozzles each comprising six nozzles. However, different numbers of nozzles may be used in each set. Preferably each set of nozzles extends about a substantially 360 degree circular locus. The first and second sets of nozzles are mounted for directing their respective gas streams obliquely to the internal elongated tubular passage. In this regard, reference may be made to FIGS. 2 and 3 and in particular to FIG. 2 which shows a first set of nozzles 20A at the right in FIG. 2 and a second set of nozzles 20B to the left in FIG. 2. It is noted that each of these sets of nozzles directs a stream at an angle X that is oblique to the center axis Y of the elongated tubular passage 70. The angle X is less than 90 degrees and is preferably in a range of 15-60 degrees. Both angles are preferably the same.

The first and second sets of nozzles are mounted for directing the respective gas streams in a direction having a compressed gas stream component toward each other for discharge transversely from the housing through the transverse port 76. As illustrated in FIG. 2, the port 76 actually passes through each of the respective housing sections 12A and 12B. Refer also to FIGS. 9 and 10 for an illustration of the transverse port 76 which is illustrated as being threaded so as to receive a fitting 77 that is illustrated in FIG. 1. This transverse porting enables the discharged product from being forced in either direction away from the device and in a direction orthogonal to the direction of travel of the wiring or cabling. In accordance with the present invention this discharge may occur through both ports or through selectively either one of the ports 76.

FIG. 2 illustrates the first and second sets of nozzles, namely nozzles 20A and 20B. FIG. 2 also illustrates the manner in which the nozzles are disposed. Each of the nozzles has an outlet port at 77. Refer also to FIGS. 9 and 10 that show the ports 77. With three nozzles on either side in each of the housing sections, there will thus be a corresponding number of three ports.

FIG. 2 also shows the direction of travel of the elongated cabling or wiring along the axis Y. The nozzle set 20A thus is directed in a direction having a component opposite to the direction of travel of the wire or cabling as indicated by the arrow A. This means that there would be a tendency, if only nozzles 20A were used, for a discharge to occur in a direction opposite to the direction of movement of the elongated member. However, in accordance with the present invention, there is also provided a second set of nozzles identified in, for example, FIG. 2 as nozzles 20B which direct the compressed air stream having a component in an opposite direction to that of the nozzle set 20A. This creates a relatively high pressure area at 78 causing a discharge from the housing along the direction of arrows R. In this regard a vacuum occurs at 79 near the exit of the housing. This arrangement provides for a discharge of the liquid or fluid in a direction substantially transverse and preferably orthogonal to the axis Y. This is particularly important in connection with an arrangement in which air wiping devices may be ganged from one to the next in a relatively small area.

Having now described a limited number of embodiments of the present invention, it should now be apparent to one skilled in the art that numerous other embodiments and modifications thereof are contemplated as falling within the scope of the present invention.

What is claimed is:

1. An air wiping device for drying an elongated product that passes through the air wiping device, said air wiping device comprising:

a housing having an internal elongated tubular passage through which the elongated product extends and including opposite one and other ends;

said housing tubular passage having an inlet end and an outlet end for respectively receiving and passing the elongated product;

a first set of nozzles mounted at the one end of the housing for communicating a compressed gas stream to the internal elongated tubular passage; a second set of nozzles mounted at the other end of the housing for communicating a compressed gas to the internal elongated tubular passage;

said first and second sets of nozzles mounted for directing the respective gas streams obliquely to the internal elongated tubular passage;

said first and second sets of nozzles mounted for directing the respective gas streams in a direction having a compressed gas stream component toward each other for discharge transversely from the housing.

2. The air wiping device of claim 1 wherein the housing is separated into two housing sections.

3. The air wiping device of claim 2 wherein the housing sections are connected by a hinge that biases the housing sections to a closed position.

4. The air wiping device of claim 3 wherein each of the sets of nozzles are disposed about a 360 degree locus.

5. The air wiping device of claim 2 wherein each of the housing sections is substantially semi-circular in shape.

6. The air wiping device of claim 2 wherein the input end of the housing tubular passage includes a tapered input through which the elongated product is received and an output through which the elongated product passes from the housing.

7. The air wiping device of claim 6 including a mounting bracket for the housing that mounts the housing in a manner by which the housing may still move toward an open position should an object associated with the elongated product engage the tapered input so as to avoid damage to the device.

8. The air wiping device of claim 7 wherein the housing sections include a slot that is used for the support of the housing from the bracket.

9. The air wiping device of claim 2 wherein the first and second sets of nozzles extend at substantially the same angle to the longitudinal axis of the housing.

10. The air wiping device of claim 1 wherein the elongated tubular passage is defined with a tapered input through which the elongated product is received and an output through which the elongated product passes from the housing.

11. The air wiping device of claim 1 wherein the housing includes a transverse port that extends substantially orthogonal to the elongated tubular passage in the housing and for receiving the discharge from the housing.

12. The air wiping device of claim 1 wherein the housing includes a pair of separable housing sections and a transverse port that extends between the housing sections substantially orthogonal to the elongated tubular passage in the housing and for receiving the discharge from the housing.

13. An air wiping device for drying an elongated product that passes through the air wiping device, said air wiping device comprising:

a housing having an internal elongated tubular passage through which the elongated product extends and including opposite one and other ends;

said housing tubular passage having an inlet end and an outlet end for respectively receiving and passing the elongated product;

a first set of air outlets mounted at the one end of the housing for communicating a compressed gas stream to the internal elongated tubular passage; a second set of air outlets mounted at the other end of the housing for communicating a compressed gas to the internal elongated tubular passage;

said first and second sets of air outlets mounted for directing the respective gas streams obliquely to the internal elongated tubular passage;

said first and second sets of air outlets mounted for directing the respective gas streams in a direction having a compressed gas stream component toward each other for discharge transversely from the housing;

each said set of air outlets directing an air stream at substantially the same angle to the elongated member axis, and each at an angle less than 90 degrees.

14. The air wiping device of claim 13 wherein the housing is separated into two housing section, the housing sections are connected by a hinge that biases the housing sections to a closed position and each of the sets are disposed about a 360 degree locus.

15. The air wiping device of claim 13 wherein each of the housing sections is substantially semi-circular in shape.

16. The air wiping device of claim 13 wherein the input end of the housing tubular passage includes a tapered input through which the elongated product is received and an output through which the elongated product passes from the housing.

17. The air wiping device of claim 16 including a mounting bracket for the housing that mounts the housing in a manner by which the housing may still move toward an open position should an object associated with the elongated product engage the tapered input so as to avoid damage to the device.

18. The air wiping device of claim 17 wherein the housing sections include a slot that is used for the support of the housing from the bracket.

19. The air wiping device of claim 13 wherein the housing includes a transverse port that extends substantially orthogonal to the elongated tubular passage in the housing and for receiving the discharge from the housing.

20. The air wiping device of claim 13 wherein the housing includes a pair of separable housing sections and a transverse port that extends between the housing sections substantially orthogonal to the elongated tubular passage in the housing and for receiving the discharge from the housing.

* * * * *